US005297731A

United States Patent [19]

Bucceri

[11] Patent Number: 5,297,731

[45] Date of Patent: Mar. 29, 1994

[54] SNOW MAKING APPARATUS

[76] Inventor: Alfio Bucceri, 15 Yarradale Street, Newmarket, Queensland, 4051, Australia

[21] Appl. No.: 877,168

[22] PCT Filed: Dec. 24, 1990

[86] PCT No.: PCT/AU90/00610

§ 371 Date: Jul. 1, 1992

§ 102(e) Date: Jul. 1, 1992

[87] PCT Pub. No.: WO91/10104

PCT Pub. Date: Jul. 11, 1991

[30] Foreign Application Priority Data

Jan. 2, 1990 [AU] Australia ..... PJ8063
May 22, 1990 [AU] Australia ..... PK0274

[51] Int. Cl.[5] ..... F25C 3/04

[52] U.S. Cl. ..... 239/14.2; 239/2.2; 62/72

[58] Field of Search ..... 239/2.2, 14.2; 62/72, 62/353

[56] References Cited

U.S. PATENT DOCUMENTS

| | | | |
|---|---|---|---|
| 1,451,902 | 4/1923 | Field | 62/72 |
| 1,451,904 | 4/1923 | Fieed et al. . | |
| 1,482,227 | 1/1924 | Field | 62/72 |
| 1,878,759 | 9/1932 | Copeman et al. . | |
| 2,259,841 | 10/1941 | Spiegl . | |
| 2,582,250 | 1/1952 | Hershberg et al. | 62/72 |
| 2,683,359 | 7/1954 | Green | 62/72 |
| 2,730,865 | 1/1956 | Murdock | 62/353 |
| 3,255,606 | 6/1966 | Hammer | 62/72 |
| 3,404,543 | 10/1968 | Diblick | 62/353 |
| 4,345,439 | 9/1982 | Gundlach . | |
| 5,062,279 | 11/1991 | Kawashima et al. | 239/14.2 |

FOREIGN PATENT DOCUMENTS

| | | |
|---|---|---|
| 49941/85 | 7/1986 | Australia . |
| 7701193 | 4/1977 | Netherlands . |
| 695696 | 8/1953 | United Kingdom . |
| 922544 | 4/1963 | United Kingdom . |

OTHER PUBLICATIONS

Derwent Abstract Accession No. C6614X/12, NL, A 741523 (Grasso Konink Mach), Mar. 1976.

*Primary Examiner*—Andres Kashnikow
*Assistant Examiner*—Christopher G. Trainor
*Attorney, Agent, or Firm*—Helfgott & Karas

[57] ABSTRACT

An apparatus for making artificial snow includes a flexible pipe which encloses a plurality of longitudinal conduits receiving and holding water therein. The pipe is cooled by a coolant liquid so that ice crystals form in the water on the surfaces of the conduits. A frame member is provided, oriented transversely to the axis of the pipe, which is movable axially along the pipe. Rollers provided on the frame member dislodge the ice crystals from the surfaces of the conduits. A seeve member is provided to strain the dislodged ice crystals from the water. The ice crystals are then conveyed to a desired area.

16 Claims, 6 Drawing Sheets

Fig. 6.
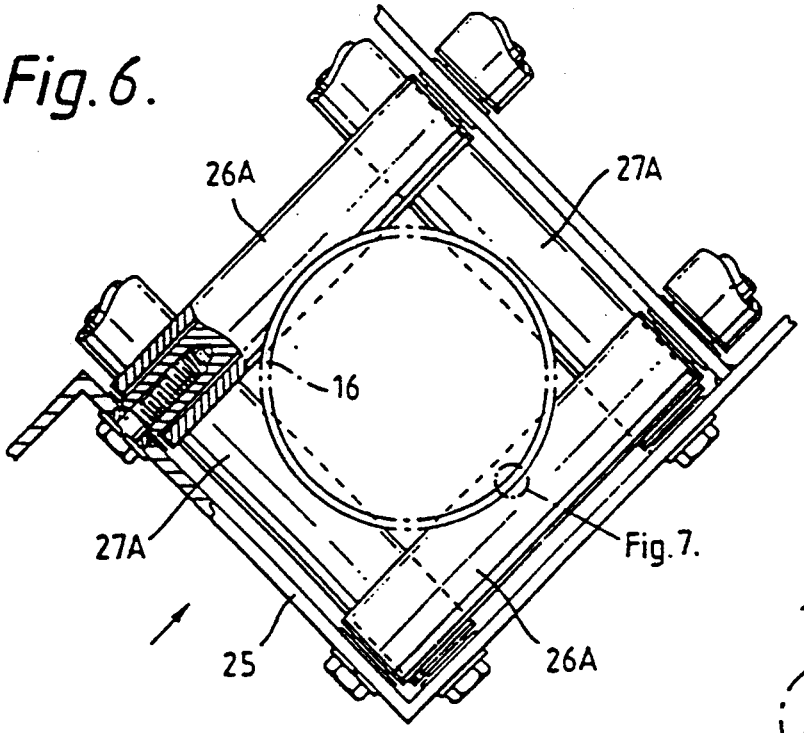
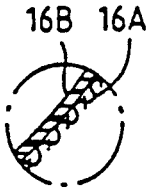
Fig. 7.
Fig. 8.
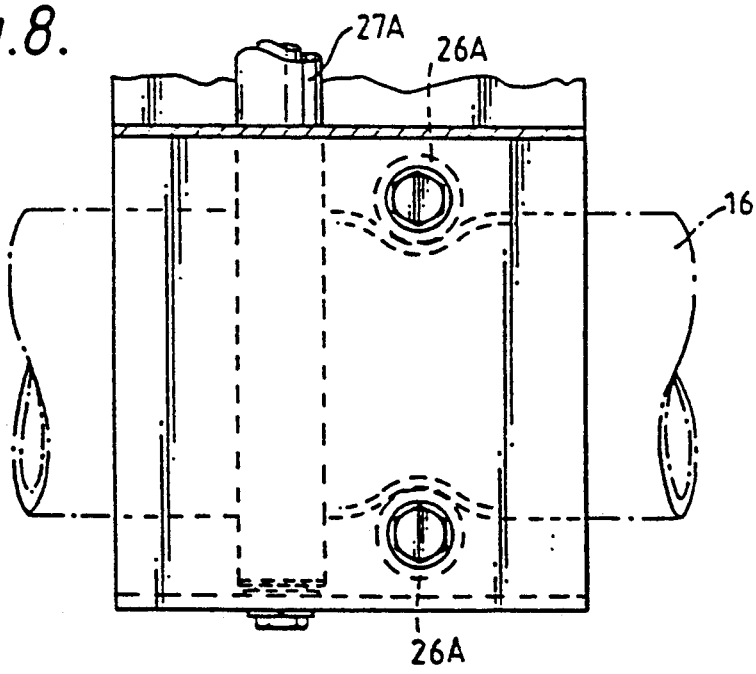

SNOW MAKING APPARATUS

THIS INVENTION relates to apparatus and method of artificial snow making. In particular, the invention is directed to a heat exchange system for making artificial snow in the form of small ice crystals.

BACKGROUND ART

At many snowfields and ski resorts, the weather is notoriously fickle, and there is often no snow or insufficient snow for enjoyable skiing. It is therefore necessary to augment natural snowfall with artificial snow.

It is known to make artificial snow by releasing a mist of atomised water and compressed air into a sub-zero temperature environment. The atomised water freezes to form minute ice crystals which, when accumulated, resemble snow. There are various known machines which have been developed to produce snow in this manner, and examples of such machines can be found in U.S. Pat. Nos. 2,676,471; 3,567,115; 3,716,190; 4,083,492; 4,004,732; 4,105,181 and 4,475,688.

However, the method cf making artificial snow in the abovedescribed manner has several inherent disadvantages. First, conventional snow making systems are very dependent on ambient conditions. The snow production rate, and the capacity of the snow making machines, decrease as the air temperature and humidity increase. Above zero degrees Celsius (0° C.) snow cannot be produced efficiently using such known machines, unless an extremely low humidity exists. With the gradual heating of the earth due to the "greenhouse effect", the compressed air and atomised water method of making snow is becoming less effective.

Most revenue in commercial ski fields is generated on weekends and holidays. Such revenue can be maximised by ensuring that there is adequate (artificial) snow coverage during those peak use periods in the event of inadequate natural snow. Due to the fickleness of the weather however, there is no guarantee that the conventional systems will be able to operate to generate adequate snow coverage for these peak periods. Conversely, there are times, such as during the working week, when the revenue obtained from a relatively low number of skiers does not justify the high cost of creating the artificial snow by conventional methods and machines.

Secondly, known snow making machines are expensive to construct and operate. Since such snow making machines may remain idle when temperatures are above 0° C. despite strong skier demand for snow, the snow machines do not fulfil their intended purpose and represent an inefficient use of large capital resources. Even if the temperature falls below zero, this normally occurs only during the night, and the machines are operative only about five hours in each day.

Thirdly, conventional snow making systems using compressed air and atomised water are not suitable for use in excessively windy weather or during rain periods, or near skiers.

Finally, the use of compressed air by the known snow making machines creates a loud noise level while those machines are operating, typically in the middle of the night. Such a noisy environment is detrimental to the wellbeing and sleep of skiers who may be staying at the ski lodges in the vicinity of the ski runs, and in any case, is generally inconsistent with the peaceful alpine environment of a typical ski field.

Despite the above limitations and disadvantages of known snow making systems, they have become increasingly popular and are virtually essential for a profitable ski field operation. Any prolonged period without snow can be financially disastrous for a commercial ski resort. For this reason, ski operators are forced to spend large amounts in capital expenditure and operating costs in providing the artificial snow making capacity.

It is an object of the present invention to provide an improved snow making method and apparatus which overcomes or substantially ameliorates, at least some of the disadvantages mentioned above.

STATEMENT OF THE INVENTION

In one broad form, the present invention provides apparatus for making artificial snow or a snow-like substance, the apparatus comprising:

at least one conduit adapted to carry water;

cooling means for cooling the conduit so that ice crystals form in the water on the surface of the conduit;

means for dislodging the ice crystals so formed from the surface into the water; and means for separating the ice crystals from the water.

Typically, the snow making apparatus comprises a plurality of conduits located within a pipe which is laid, either above or below the ground, along the side of a ski run, or near the area where the artificial snow is to be distributed or stockpiled. In use, water is pumped through each conduit at a predetermined rate. Each conduit is preferably flexible to some degree and, in the preferred embodiment, each conduit is a tube constructed from a tightly-woven textile material coated on its inside with flexible impervious plastics or rubber material.

The cooling means preferably comprises a flow of chilled brine solution, or a solution of glycol and water, or other suitable coolant, pumped through the pipe and around the tubes. The coolant liquid is typically at approximately −5° C. As the coolant flows around the outer surface of the tubes, the temperature of the tubes will fall below 0° C., thereby causing ice crystals to be formed in the water on the inner surfaces of the tubes. Preferably, the inner surfaces of the tubes are roughened, knurled or provided with a series of shallow cuts to enhance or accelerate the formation of the ice crystals.

In the preferred embodiment, the means for dislodging the ice crystals from each cooled tube comprises two orthogonal sets of spaced parallel rollers between which the respective tube is located. The tube is squeezed or otherwise deformed between the rollers which in use are moved along the tube. As the rollers pass over the tube, the immediate surface of the tube flexes, causing the ice crystals formed on the inside surface of the tube to be dislodged into the flow of water. The dislodged ice crystals are delivered by flotation and water flow to an outlet pipe in fluid communication with the upper end of each tube.

The means for separating the ice crystals from the water can comprise a mesh or sieve arrangement which allows the water to pass through while collecting the ice crystals. The mesh or sieve can be mounted for rotational movement so that the collected ice crystals are conveyed by centrifugal force to a collection area. Alternatively, the water flow may be discharged onto the ground so that the ice crystals can be stockpiled on the ground while the water drains to a collection area for recirculation through the conduit.

The collected ice crystals can be distributed immediately over the surface of the ski run to provide an artificial snow cover, or alternatively stockpiled for subsequent distribution. Thus, artificial snow produced during the night can be distributed directly over the ski run, while artificial snow created during the day can be stockpiled for subsequent distribution.

The snow making apparatus and method of the present invention has several advantages, including:

(a) As snow production is carried out in a closed environment, operation is not dependent on ambient temperature, i.e. the artificial snow can be produced at above or below 0° C. temperatures.

(b) The snow can be produced on a continuous basis, 24 hours a day, irrespective of ambient humidity, wind conditions, and rainfall.

(c) The snow can be produced economically, with minimum operational noise, and without disturbing skiers or interrupting skiing activities.

(d) The snow can be stored economically for subsequent use when demand is greatest.

(e) The low ambient air temperatures at ski resorts can be utilised to directly cool the brine solution and eliminate the need for refrigerating machinery, thereby reducing production costs.

(f) The snow making apparatus can use conventional refrigeration equipment which is readily available and hence reasonably priced. The equipment can be adapted for operation with a low condensing temperature to reduce power requirements and compressor capacity.

(g) The snow making apparatus can be installed easily, and is relatively simple to operate.

(h) The snow making apparatus can be used during the off season as a cooling unit and its waste heat can be used for heating other areas of the ski resort during the skiing season.

In order that the invention may be more fully understood and put into practice, a preferred embodiment thereof will now be described with reference to the accompanying drawings.

BRIEF DESCRIPTION OF THE DRAWINGS

FIG. 6 is an end view of the ice dislodging means for one tube;

FIG. 7 is an enlarged detail of part of the tube of FIG. 6;

FIG. 8 is an elevation of the ice dislodging means of FIG. 6 in the direction of the arrow.

DESCRIPTION OF PREFERRED EMBODIMENT

The snow making apparatus of the illustrated embodiment comprises a production pipe 10 which, in use, extends along the hillside typically adjacent the ski slope where snow coverage is to be augmented by artificial snow. The pipe 10 is made of a suitable material, such as metal, PVC tubing, concrete or of composite materials. The pipe 10 may be constructed from a number of joined sections. Typically, the pipe 10 has an internal diameter between 100 cm and 1 meter, depending upon the required snow production capacity of the apparatus.

Figure 2:
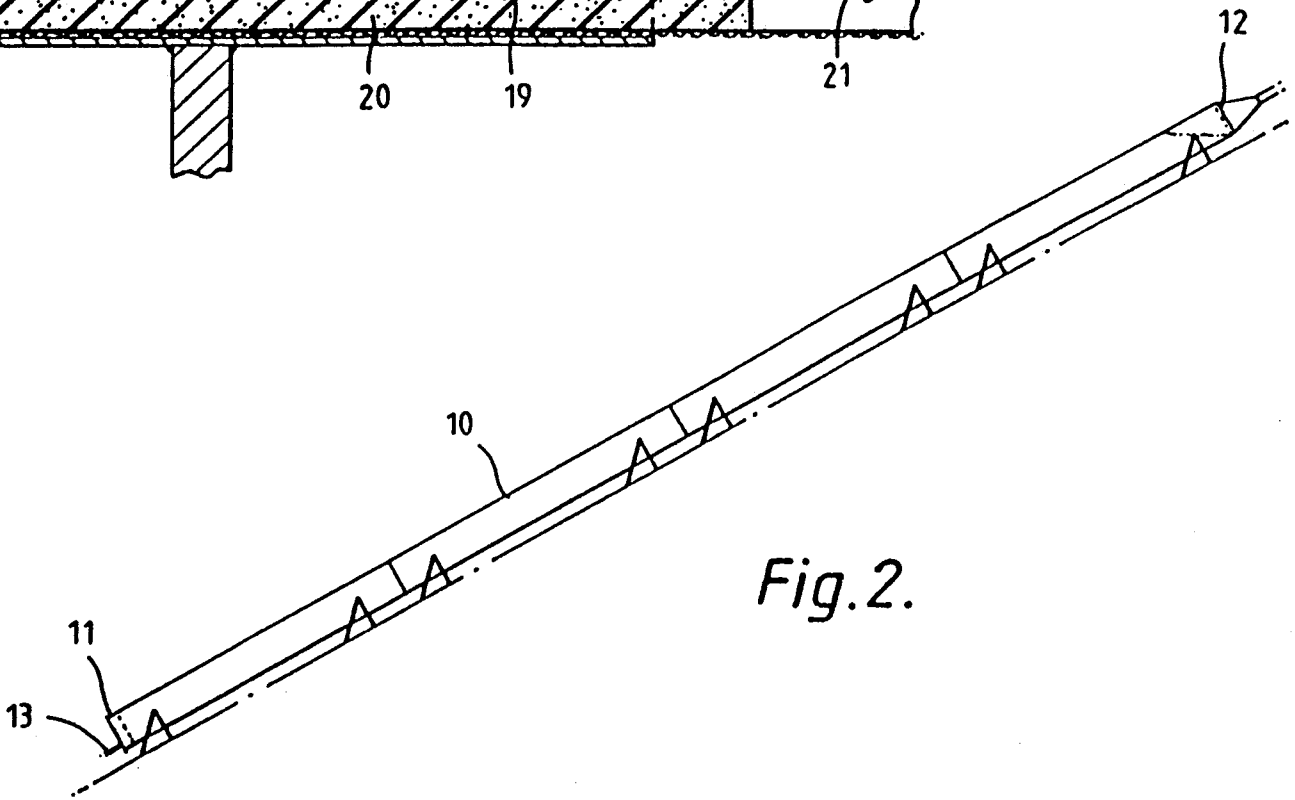
FIG. 2 is a side elevation illustrating the mounting of the production pipe of FIG. 1 on a hillside in use.

The pipe 10 is preferably laid in a straight line, and may be suitably insulated. The pipe can be mounted above ground as shown in FIG. 2, laid on the ground, or even buried under the ground.

Figure 3:
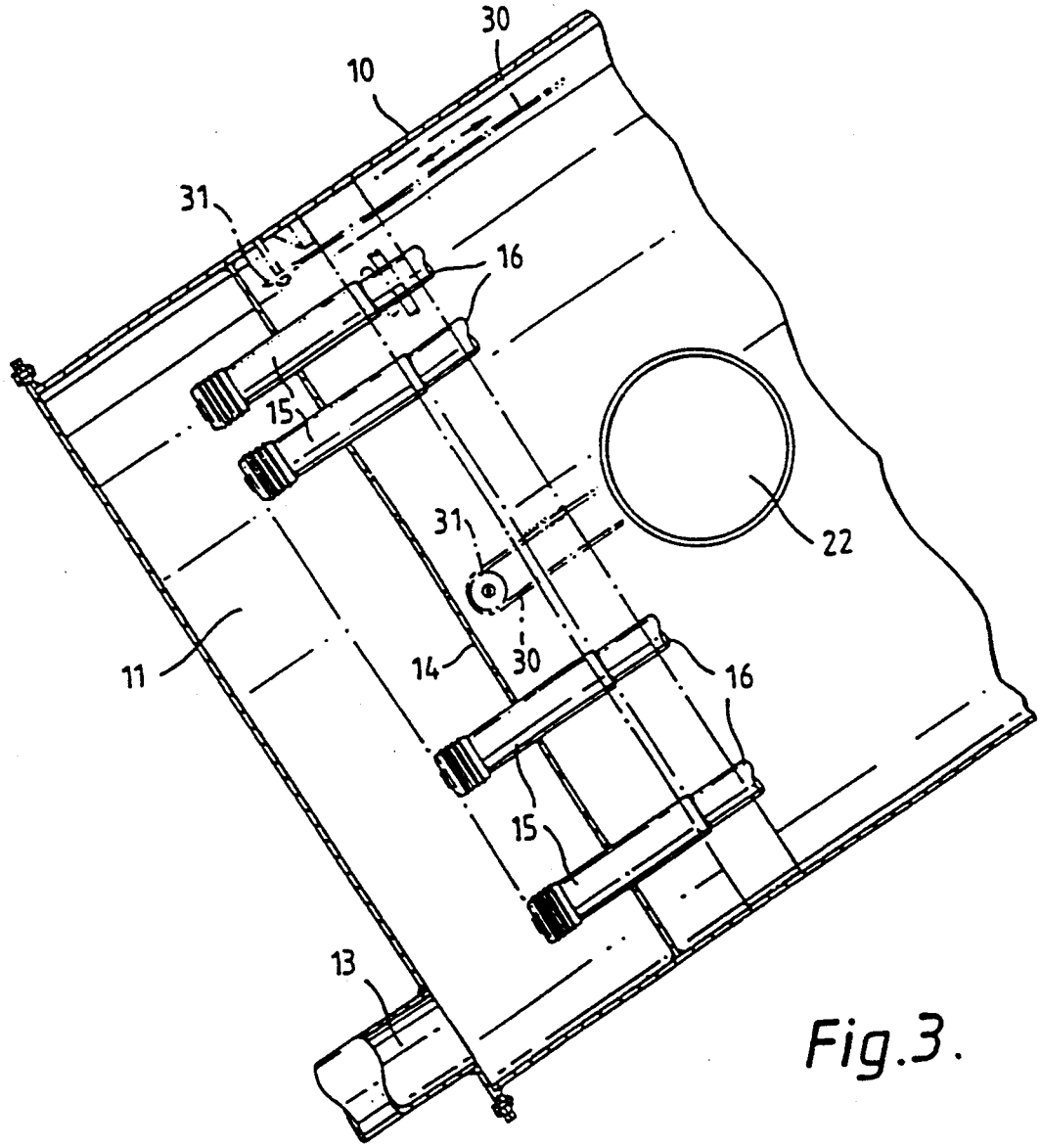
FIG. 3 is a part sectional elevation of the lower end of the production pipe of FIG. 1.
Figure 5:
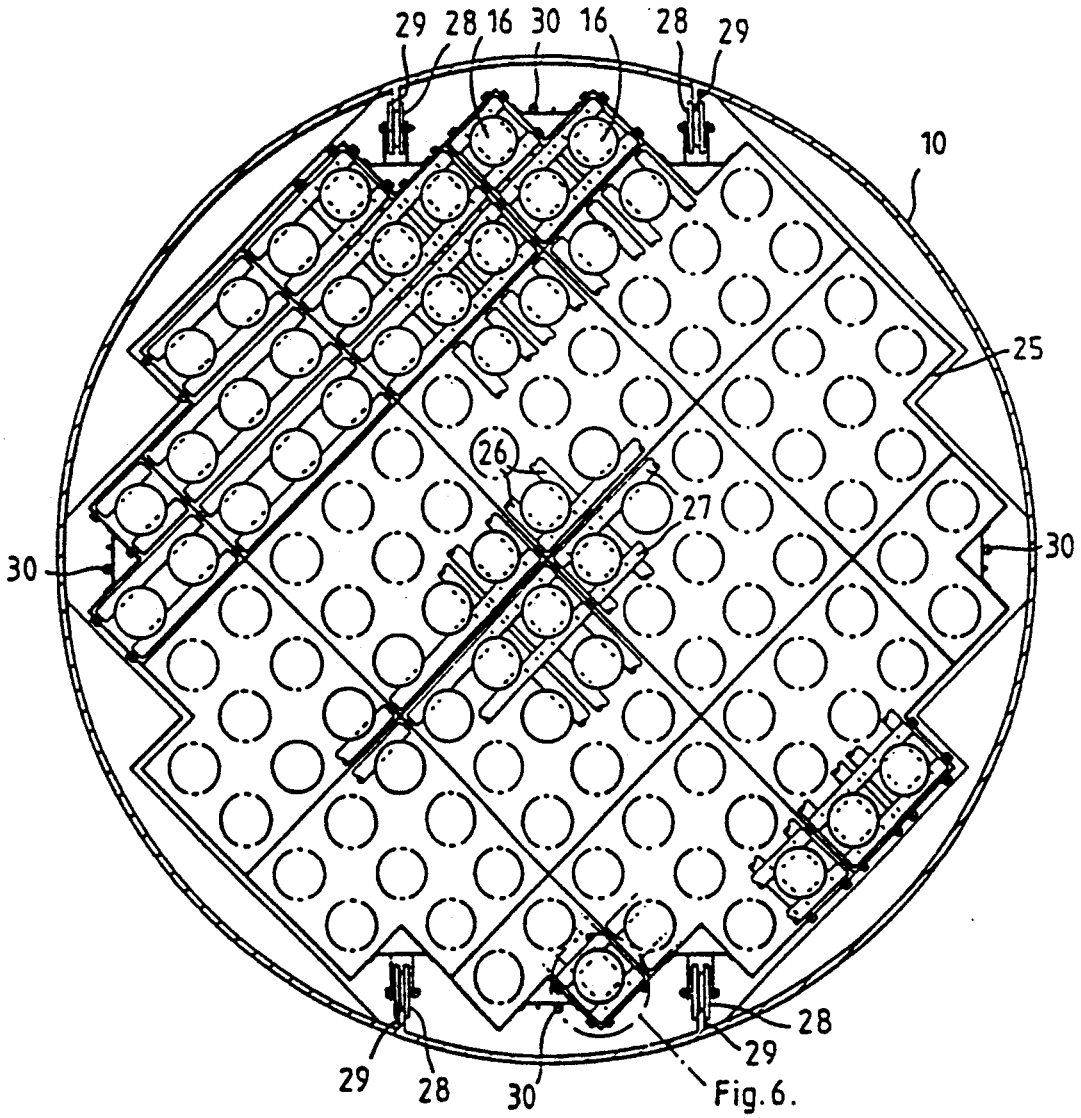
FIG. 5 is an incomplete cross-sectional view of the production pipe of FIG. 1 showing the ice dislodging means.

The pipe 10 is provided with respective headers 11, 12 at its lower and upper ends, the lower header 11 being shown in more detail in FIG. 3. The lower header 11 is connected to an inlet water pipe 13, and comprises a manifold plate 14 having a plurality of short pipe fittings 15 therethrough as can be seen in FIG. 3. Typically, the manifold plate 144 has a series of holes punched or bored therethrough, and a short pipe fitting 15 is inserted through each hole and welded and sealed to the manifold plate 14. The manifold plate 14 and the short pipe fittings 15 can be made of stainless steel, tough plastics . material, or any other suitable material. In the illustrated embodiment, a total of 112 pipe fittings 15 are provided in the manifold plate 14.

Each short pipe fitting 15 provides a termination for a respective flexible tube 16 extending between the top and bottom headers of pipe 10. Each flexible tube 16 is typically constructed from a tightly-woven textile material 16A (e.g. canvas) and lined internally with a thin flexible impervious plastics, or rubber coating 16B (FIG. 7). The tube 16 is conductive to heat.

Figure 4:
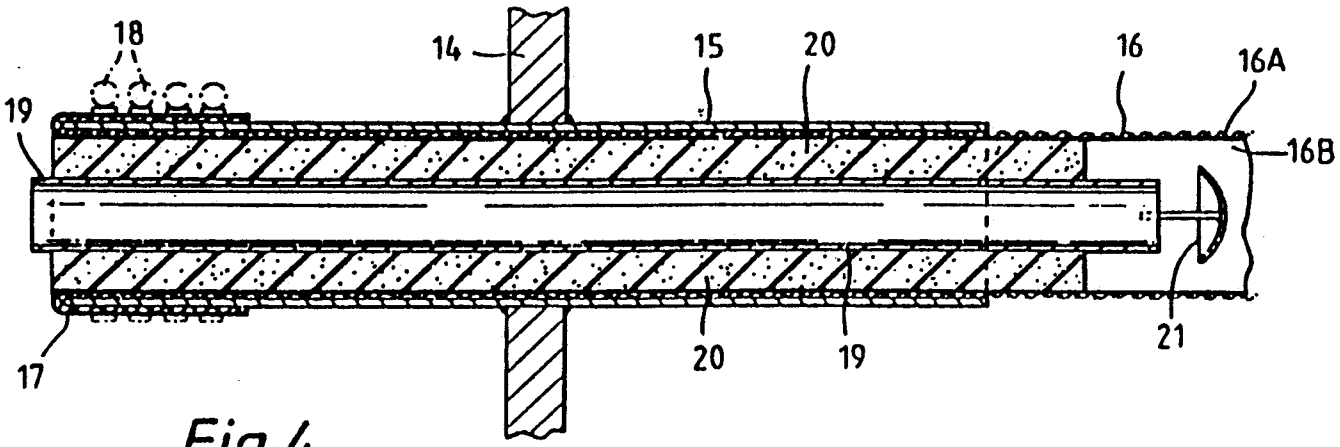
FIG. 4 is a sectional elevation of the lower end of a heat exchange tube of the production pipe of FIG. 3.

As shown, in FIG. 4, the bottom end of each tube 16 is pulled through the short pipe fitting 15 and retroverted around the bottom end of the pipe fitting 15. The retroverted portion 17 of tube 16 on the outside of pipe 15 is bound in place by retaining clips 18 or any other suitable device. A feed pipe 19 of smaller diameter is inserted within the short pipe fitting 15, and thermal insulation is provided between pipes 15 and 19. Typically, the thermal insulation 20 is foamed neoprene insulation which is press fitted between the pipes 15, 17. Advantageously, a diverting baffle mechanism 21 is located at the inner end of feed pipe 19. The purpose of the insulation 20 and baffle 21 will be described below.

The upper end of each flexible tube 16 is similarly terminated at a respective short pipe fitting in a baffle plate in the upper header 12. However, unlike the cylindrical shape of the lower header 11, the upper header 12 has a conical shape and communicates with an outlet pipe located at the apex of the cone.

The pipe 10 is provided with an inlet and outlet to permit a coolant liquid to flow therethrough. The inlet and outlet are located between the upper and lower headers and typically, the inlet is located adjacent the upper end of pipe 10 while the outlet is located adjacent the bottom end of the pipe 10. The location of the coolant outlet 22 in pipe 10 is illustrated in FIG. 3. Typically, the coolant is brine chilled to approximately −5° C., but any other coolant liquid, such as a chilled solution of glycol (ethylene or propylene) and water, may be used.

In use, water is pumped through inlet pipe 13 into header 11 from where it flows into the individual tubes 16 to the upper header 12. Chilled brine or other coolant solution is pumped into the inlet of pipe 10 from where it flows under gravity to the outlet 22. As the tubes 16 are cooled below 0° C. by the coolant liquid, ice crystals form on the inner plasticised coating of the tubes 16. To accelerate the formation of ice crystals on the inside surfaces of the tubes 16, the surfaces are preferably, roughened, knurled or provided with a series of shallow cuts or indentations. The ice crystals are then dislodged from the inner surface of tubes 16 by ice dislodging means shown in more detail in FIGS. 5 to 8.

The ice dislodging means comprises one or more generally planar frames 25 mounted transversely inside the pipe 10. The number of frames required will depend upon the length of pipe 10. The frames 25 also serve to maintain the tubes 16 at their correct spacings and positions.

Each frame 25 comprises a first series of parallel rollers 26, and a second series of parallel rollers 27 arranged orthogonally to the first and offset slightly therefrom in the axial direction of the pipe 10. Each roller is typically a rotatably mounted stainless steel round tube or cylinder. The tubes 16 pass through the interstices of the grid formed by the cross-orientated rollers. As shown more clearly in FIG. 6, a pair of spaced parallel rollers 26A are located on opposite sides of a flexible tube 16 perpendicularly thereto, and a second pair of spaced rollers 27A are also located on opposite sides of tube 16 perpendicularly thereto, but orientated orthogonally to the first pair of rollers 26A. The spacing between the rollers in each pair is less than the diameter of the tube 16 such that the tube 16 is slightly squeezed or pinched between each pair of rollers 26A, 27A.

Each frame 25 is mounted on roller wheels 28 which engage and run along rails 29 provided on the inside of pipe 10. Each frame 25 is connected to one or more cables 30, chains or the like which extend axially along the inner periphery of pipe 10 between pulleys 31 or sprockets located at opposite ends of pipe 10 (FIG. 3). By suitable rotation of the pulleys 31, the frames 25 can be moved up and down the pipe 10 as required. As each frame 25 moves along the pipe 10, the rollers 26, 27 will progressively squeeze, pinch or otherwise deform the respective tubes 16 locally to dislodge any ice crystals formed on the inside of the tubes 16. The dislodged ice crystals float to the upper header 12 through the combined action of natural flotation assisted by the flow of water through pipes 16.

The operation of the abovedescribed snow making system will now be described with particular reference to FIG. 1. A cold water storage tank 35 is filled from a mains water supply 36. The water may optionally be precooled by ambient air using fans 37 if the ambient temperature is sufficiently low, and/or by chilled brine in a heat exchanger 38. Water from tank 35 is pumped by circulation pump 39 into the bottom header 11 of the snow production pipe 10 from where it passes into the individual tubes 16 within the pipe 10 as previously described. The thermal insulation 20 provided at the lower terminations of tubes 16 (FIG. 4) prevents icing up of the feed pipes at the lower openings of tubes 16. The baffle 21 deflects incoming water flow around the inner end of feed pipe 19 again to prevent icing up around the inner end of that pipe.

Chilled brine is pumped into the elevated inlet of pipe 10 to chill the tubes 16 therein below 0° C. thereby causing ice crystals to be formed on the inside surfaces of tubes 16. Brine is collected from the outlet 22 at the bottom end of pipe 10 and returned to a brine return header 41. If the temperature is sufficiently low, the flow of returned brine may be diverted by appropriate valves to be cooled by the ambient air using fans 42. The cooled brine is returned to the header 41 and may be recirculated to the production pipe 10 if cooled sufficiently by the fans 42. Chilled brine is also circulated to the precooler heat exchanger 38 and returned to the header 41. During maintenance or servicing of production pipe 10, it may be necessary to drain the pipe 10. Brine recovery pump 43 is used to pump the brine to a recovery tank 44 for subsequent feed to the header 41.

The brine in header 41 is pumped to the refrigeration plant and back to the pipe 10 by brine circulation pump 45. The brine may be cooled by brine chilling or refrigeration equipment 40, or in cooling tower 46 if the ambient temperatures are sufficiently low. Waste heat from the brine refrigeration equipment may be recovered through a heat exchanger 47 for use in heating premises at the snow field.

At predetermined intervals of time, each frame 25 containing the ice dislodging mechanism is pulled along the pipe 10 to dislodge ice crystals formed on the inside of tubes 16. These ice crystals are carried with the flow of water inside tubes 16 through the upper header 12 to a separator 48 which separates the ice crystals from the water. The water is returned to the cold water storage tank 35, while the ice crystals are delivered as artificial snow to a stockpile 49, typically on a graded concrete holding pad 50. A snow moving machine 51 or similar device can then be used to spread or deliver the stockpiled snow 49 to the desired areas of the ski slopes. Any water from the melting ice crystals drains into a water holding tank 54 from where it is pumped by water recovery pump 53 to the water storage tank 35.

In an alternative method of delivering the dislodged ice crystals, the water is drained from tubes 16 and compressed air is led to the bottom header 11 to blow the ice crystals in the tubes 16 through the outlet pipe connected to the upper header 12. In this embodiment, the ice dislodging mechanisms are not required as the tubes 16 will collapse or deform under pressure of the brine in the pipe 10 when the water is drained from the tubes 16, thereby dislodging the ice crystals from the inside surfaces of the tubes 16. The outlet pipe connected to the upper header 12 is preferably flexible so that the flow of compressed air and ice crystals can be directed as and where required.

Figure 1:
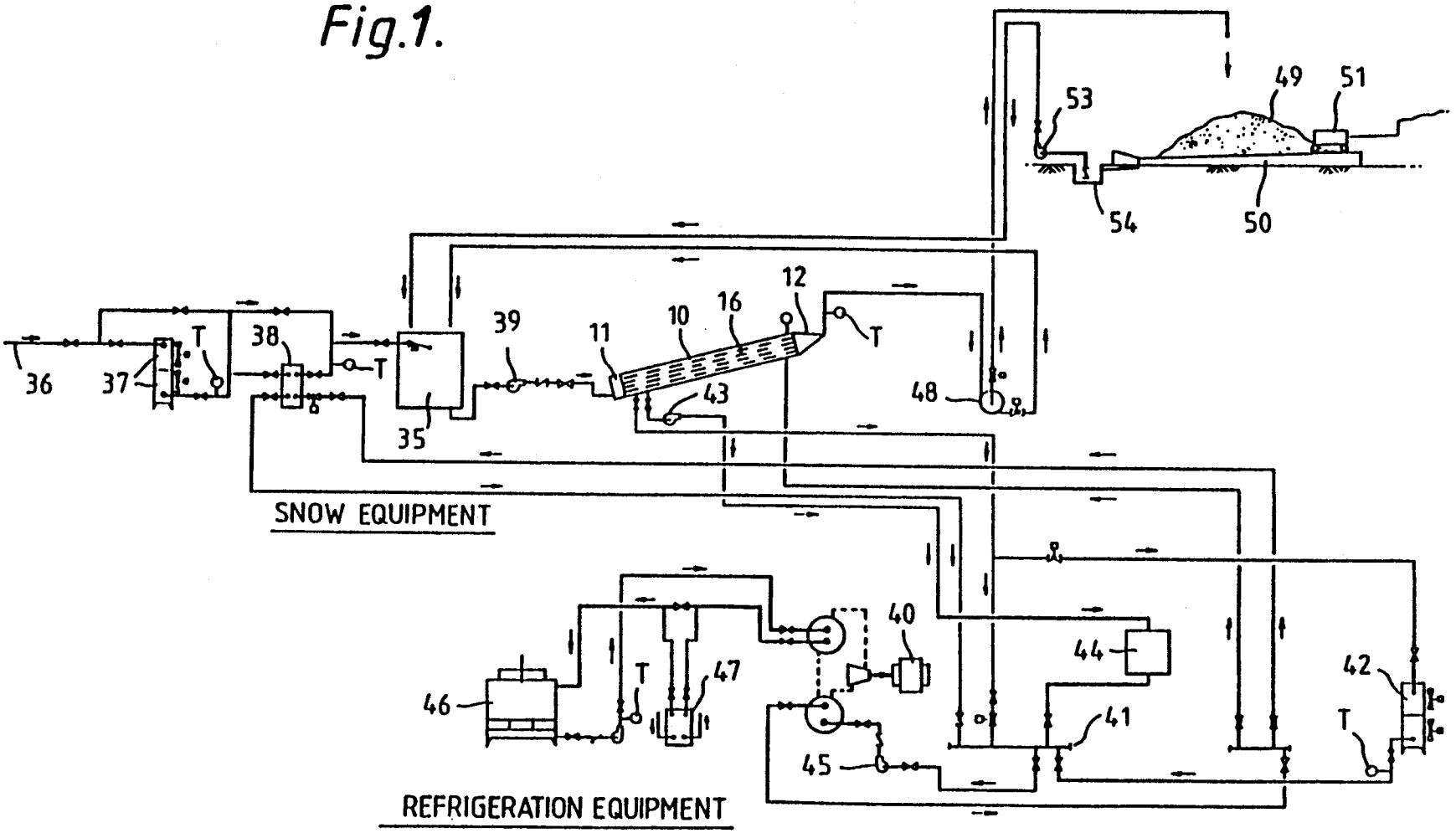
FIG. 1 is a schematic diagram of snow making apparatus constructed in accordance with an embodiment of the invention.

The snow raking apparatus of FIG. 1 is automated or computer-controlled. Thermostats, labelled "T" in FIG. 1, measure the temperature at various locations in the snow making system and such measurements are conveyed to a control computer (not shown). The output of the computer is connected to various solenoid valves as shown in FIG. 1. Thus, if ambient temperature drops below a predetermined level, the incoming water supply may be diverted by suitable valve actuation to be precooled by fans 37, and the return path of the brine may be diverted to be cooled by fans 42. In such cases, the brine refrigeration plant is not required and operational costs are significantly reduced. The actuation of the ice dislodging mechanism within pipe 10 is also timed and controlled automatically, preferably under computer software control. The snow making apparatus can be switched on and off automatically, at preset times or depending on ambient conditions, stock pile level and demand.

Figure 9:
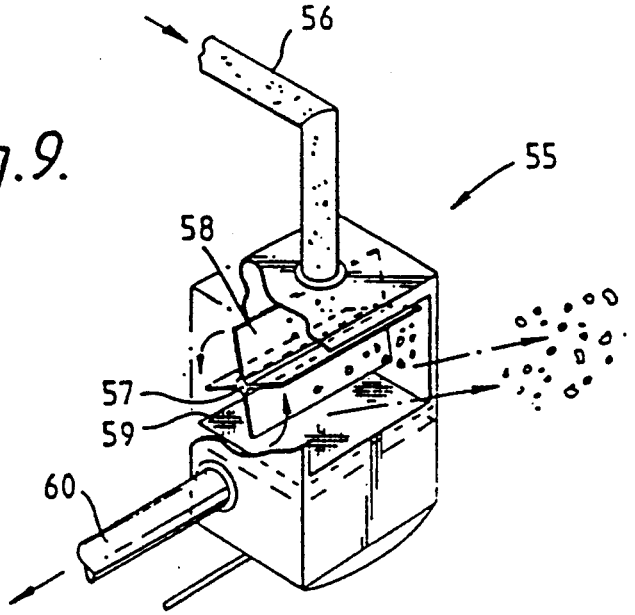
FIGS. 9 and 10 are part-sectional perspective views of alternative snow distributing devices.

Instead of using separator 48 to separate the ice crystals from the water flow and then stockpiling the ice crystals, the output of production pipe 10 can be fed to one or more combined separators/distributors for immediate slope coverage. An example of a separator/distributor is illustrated in FIG. 9. This separator/distributor 55 has an inlet pipe 56 connected to the outlet of upper header 12 of pipe 10. The inlet pipe 56 communicates with a chamber containing a revolving fan 57, which preferably has performed or mesh blades 58. The fan 57 is rotated by the flow of the ice/water mix from inlet pipe 56. Alternatively, the fan 57 may be driven by a small electric motor. The water in the ice/water mix will pass through the perforated or mesh blades 58 and a grate 59 at the bottom of the chamber, into a reservoir below. The water is recovered from the reservoir and pumped or otherwise delivered through pipe 60 to the water storage tank 35. However, the ice crystals will be separated from the water by the mesh or perforated blades 58 and expelled as artificial snow through an opening at the front of the chamber by the rotation of fan 57. The grate 59 should preferably be kept above 0° C. to prevent icing up. Each ice separator/distributor 57 is preferably mounted on a rotatable platform (not shown) so that the direction in which the artificial snow is distributed can be varied to provide even coverage over the slope.

Figure 10:
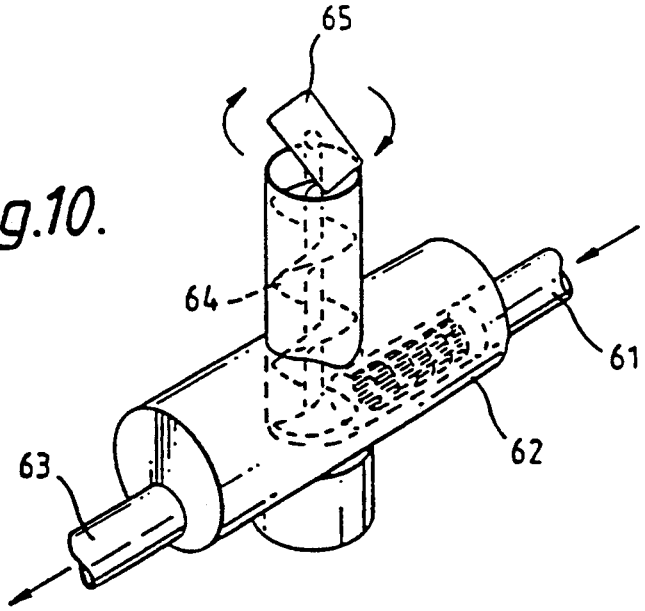

An alternative form of separator/distributor is shown in FIG. 10. A mixture of ice crystals and water enters one end of a tube or conduit 61, the other end of which is perforated or formed from mesh material and located within a tube 62 of greater diameter. In this manner, the water will pass through the mesh or perforated end of tube 61 into outer tube 62 from where it is recovered and pumped or otherwise delivered by pipe 63 to water storage tank 35. The separated ice crystals in tube 61 are fed to an upright auger 64 which spirals the ice crystals upwardly. A rotating deflector vane 65 at the top of the auger 64 deflects the flow of the ice crystals radially to spread the ice crystals as artificial snow over the surrounding terrain.

The above described snow making system provides high quality man-made snow with similar characteristics to natural snow and artificial snow as made by currently known machines. Moreover, the snow making apparatus of the described embodiment is able to produce the artificial snow continuously, economically and quietly.

The foregoing describes only some embodiments of the invention, and modifications which are obvious to those skilled in the art maybe made thereto without departing from the scope of the invention as defined in the following claims.

For example, the coolant liquid may be fed to the interior of tubes 16 and water passed over the exterior of tubes 16 in pipe 10 so that the ice crystals are formed on the exterior surfaces of the tubes 16 rather than the interior surfaces. Furthermore, the illustrated ice dislodging mechanism may be replaced by one or more cylindrical scraping devices located in or on each tube 16 which are pulled up and down the tube to scrape the ice crystals from the surface of the tube.

In the illustrated artificial snow making system, only one production pipe 10 is used. However, two or more such production pipes can be operated in parallel in a single snow making system.

I claim:

1. Apparatus for making artificial snow, comprising at least one flexible conduit adapted to hold water;

cooling means for cooling the conduit so that ice crystals form in the water on the surface of the conduit;

means for temporarily deforming the conduit to dislodge the ice crystals so formed from the surface wherein the cooling means comprises a coolant liquid in thermal contact with the conduit; and a pipe containing a plurality of the conduits extending longitudinally therein, each of the conduits being a tube adapted to carry water, wherein in use the coolant liquid is passed through the pipe in thermal contact with the exterior surfaces of the tubes, wherein the pipe comprises a header portion at each end thereof communicating with respective end openings of each tube, one of said header portions communicating with an inlet pipe and the other header portion communicating with an outlet pipe.

2. Apparatus as claimed in claim 1 wherein each of said header portions comprises a manifold plate member having a plurality of short pipe members therethrough, wherein end portions of each of said tubes are connected to a respective and as said short pipe members in said manifold plates.

3. Apparatus as claimed in claim 2 wherein the short pipe member at the inlet end of each of said tubes has an internal conduit and thermal insulation between the internal conduit and the short pipe member, further comprising a baffle member at the outlet end of the internal conduit for diverting water flow.

4. Apparatus for making artificial snow, comprising at least one flexible conduit adapted to hold water;

cooling means for cooling the conduit so that ice crystals form in the water on the surface of the conduit;

a pipe containing a plurality of the conduits extending longitudinally therein, each of the conduits being a tube adapted to carry water, wherein in use the coolant liquid is passed through the pipe in thermal contact with the exterior surfaces of the tubes, each of said tubes being constructed of flexible material; and means for temporarily deforming the conduit to dislodge the ice crystals so formed from the surface; wherein the deforming means to dislodge the ice crystals comprises at least one frame member oriented generally transversely to the axis of the pipe and movable axially along at least a portion of the pipe, the frame member having thereon a first pair of parallel rollers located on either side of each of said tubes and spaced less than the diameter of the tube, a second pair of parallel rollers located on either side of each of said tubes and spaced less than the diameter of the tube, the first and second pairs of rollers being generally orthogonal to each other and to the tube, wherein the tube is deformed by the rollers as the frame travels along the pipe to thereby dislodge the ice crystals from the interior surface of the tube.

5. Apparatus as claimed in claim 4 wherein each of said frame members is connected to a cable and pulley system within the pipe.

6. Apparatus, for making artificial snow, comprising at least one flexible conduit adapted to hold water;

cooling means for cooling the conduit so that ice crystals form in the water on the surface of the conduit;

means for temporarily deforming the conduit to dislodge the ice crystals so formed from the surface; and means for separating the ice crystals from the water, wherein the separating means comprises a sieve member for straining the dislodged ice crystals from the water, further comprising means for conveying the ice crystals to a desired area.

7. An artificial snow making system, comprising:

a pipe member having a plurality of flexible tubes extending longitudinally therein, each of said tubes having one end connected to a source of water and its other end communicating with an outlet pipe;

means for cooling a coolant liquid below 0° C.;

delivery means for circulating the coolant liquid through the pipe around the exterior of the tubes to thereby cool the tubes and promote the formation of ice crystals in the water on the inside surfaces of the tubes;

means for dislodging the ice crystals from the inside surfaces of the tubes at predetermined intervals of time; and means for delivering the ice crystals to a desired location.

8. An artificial snow making system as claimed in claim 7 wherein the cooling means include fans for cooling the coolant liquid with ambient air.

9. An artificial snow making system as claimed in claim 7 further comprising means for pre-cooling water before entering the tubes, the pre-cooling means comprising fans for cooling the water using ambient air.

10. An artificial snow making system as claimed in claim 7 wherein the flow of water and coolant liquid in the system is controlled by computer-controlled valves, and the operation of the ice dislodging means is automatic.

11. An artificial snow making system as claimed in claim 7 wherein the ice dislodging means comprises means for locally deforming the tubes progressively along their lengths to dislodge the ice crystals from the surfaces of the tubes.

12. An artificial snow making system as claimed in claim 7 wherein the ice dislodging means comprises scraper devices for scraping the ice crystals from the surfaces of the tubes.

13. An artificial snow making system as claimed in claim 7 wherein the ice dislodging means comprises a source of compressed air for blowing the ice crystals from the surfaces of the tubes.

14. An artificial snow making system as claimed in claim 7, wherein each tube is made from a woven textile fabric having a thin impervious layer on the inside thereof of plastics or rubber material.

15. Snow making apparatus comprising at least one tube adapted to hold water;

cooling means for cooling the tube below 0° C. to thereby cause ice crystals to form in the water on the surface of the tube;

means for draining the water from the tube; and means for blowing air through the tube to thereby dislodge the ice crystals so formed from the surface of the tube.

16. Snow making apparatus as claimed in claim 15, wherein said tube is made from a woven textile fabric having a thin impervious layer on the inside thereof of plastics or rubber material.

* * * * *